US008291897B2

(12) United States Patent
Shea

(10) Patent No.: US 8,291,897 B2
(45) Date of Patent: Oct. 23, 2012

(54) MATERIAL FEED SYSTEM FOR MELTER KETTLES

(76) Inventor: James P. Shea, Troy, MI (US)

( * ) Notice: Subject to any disclaimer, the term of this patent is extended or adjusted under 35 U.S.C. 154(b) by 0 days.

(21) Appl. No.: 12/336,648

(22) Filed: Dec. 17, 2008

(65) Prior Publication Data

US 2011/0253124 A1 Oct. 20, 2011

Related U.S. Application Data

(60) Provisional application No. 61/014,458, filed on Dec. 18, 2007.

(51) Int. Cl.

| | |
|---|---|
| ***E01C 19/45*** | (2006.01) |
| ***C10C 3/12*** | (2006.01) |
| ***F27D 3/00*** | (2006.01) |
| ***F27D 1/18*** | (2006.01) |
| ***F26B 3/00*** | (2006.01) |

(52) U.S. Cl. ..... 126/343.5 R; 126/343.5 A; 432/87; 432/210; 432/242

(58) Field of Classification Search ..... 126/343.5 A, 126/343.5 R; 432/87, 210, 242
See application file for complete search history.

(56) References Cited

U.S. PATENT DOCUMENTS

| | | | | |
|---|---|---|---|---|
| 2,413,326 | A * | 12/1946 | Kressman et al. | 530/210 |
| 3,804,079 | A * | 4/1974 | Schrader | 126/343.5 A |
| 4,082,083 | A * | 4/1978 | Horne | 126/343.5 A |
| 4,462,547 | A * | 7/1984 | Metz | 239/130 |
| 5,131,788 | A * | 7/1992 | Hulicsko | 404/108 |
| 2004/0099212 | A1* | 5/2004 | Dirienzo et al. | 118/108 |

* cited by examiner

*Primary Examiner* — Kenneth Rinehart
*Assistant Examiner* — William Corboy
(74) *Attorney, Agent, or Firm* — Brinks Hofer Gilson & Lione

(57) ABSTRACT

A material feed system for melter kettles which provides an area for a tender to load material to be charged into a melter kettle at a location which is safely remote from a flame conductor assembly that allows any flames or gasses that build up in melter kettle to be released. The material feed system also includes an air intake duct through which free air is allowed to enter into the melter kettle so as to equalize pressure with the atmosphere and/or burn off any superheated material.

17 Claims, 4 Drawing Sheets

MATERIAL FEED SYSTEM FOR MELTER KETTLES

RELATED APPLICATION

This application is based upon U.S. Provisional Patent Application Ser. No. 61/014,458 to which priority is claimed under 35 U.S.C. §120 and of which the entire specification is hereby expressly incorporated by reference.

TECHNICAL FIELD

The present invention relates to melter kettles and more particularly relates to a system for charging or feeding materials into melter kettles.

BACKGROUND ART

A variety of thermoplastic materials and compositions have been developed and used in the roadway striping industry. In order to apply such thermoplastic materials and compositions, they have to be melted and mixed. Melting, which involves both initial melting from solid stock or feed materials and maintaining the materials/compositions in a molten state for application onto roadways and other pavements, is typically conducted in melter kettles which can be heated by electrical means, or combustionable fuels.

Pavement striping apparatus which are used to apply thermoplastic lane markers and other roadway and pavement informational markers include walk behind systems, systems that are pulled on trailers, and systems that are built on vehicle chassis. In the case of heavy duty commercial equipment, pavement striping apparatus or systems are built on the chassis of large trucks and can include one or more large capacity melter kettles. Such melter kettles can be quite tall and provided with various structures such as platform steps, ladder rungs, bridges, etc. by which operators or tenders can access and charge material into the tops of the melter kettles.

Traditionally thermoplastic melter kettles have been loaded manually. A person referred to herein as a tender lifts or otherwise transfers plastic bags of granular or chunk thermoplastic material to the melter kettle and introduces the material into melting kettle by releasing the material such that it falls through an opening on the top of the melter kettle. The material free falls into the melter kettle in its packaged state or solid state. Mechanical agitators in the melter kettle mix the material. The thermoplastic material can be a bagged granular material or solid block material of various sizes. Other material added can be, but is not limited to, glass beads, resins or oils. The opening at the top of the melter kettle into which the thermoplastic and other materials are feed into the melter kettle can be a hinged lid or any number of various design chutes with baffle doors.

The hinged lid offers the person or tender feeding material into the kettle no protection against splash back of molten material or blow back of flames from super heated material. When the melter kettle lid is opened while the thermoplastic is above its flashpoint oxygen is sucked into the melter kettle and ignites with an explosive force. Serious injury can be caused to anyone in the influence of the blast. Various designed baffle chutes offer some protection against splash back of material; however, blow back of flames from super heated material remains a constant danger. These hazards are serious deficiencies that need to be corrected.

There are additional problems that can occur when material is fed into melter kettles using the traditional methods. If the material is added in solid form it will melt slowly. This is because the surface area of the solid material in contact with the heated walls and floor of the melter as well as molten material in the kettle is small relative to its mass. The agitators in the kettles do not have the ability to break the solid material into smaller pieces. This material can only melt from its outer surface. This slow liquification to optimum application temperature increases both production time and job cost.

Thermoplastic material that is packaged in meltable bag form often is in a semisolid state. As stored material ages the effects of temperature and the weight of the material due to stacking causes the material to clump together. It is difficult for the agitators in melter kettles to break this material apart. Melting of this material is slower than it would be if the material were uniformly granular.

Thermoplastic bagged granular material that is in the ideal condition breaks apart readily but not immediately under agitation in the kettle. If this material were added as granules to the kettle then an optimum melt time can be achieved.

Thermoplastic material that reaches and exceeds its flashpoint must be cooled rapidly. This is for two reasons. First, superheated material can ignite with serious consequences when exposed to air. Second, the thermoplastic can break down from the effects of this heat in a short time and become waste material.

Overheated or super heated material can be cooled by the addition of unheated material to the kettle. Material added to the kettle using traditional methods as described herein has a low efficiency of cooling.

The present invention allows for the safe addition of uniformly granular cooling material into the melter kettle and provides a greater degree of cooling efficiency than is possible with current state of the art systems.

DISCLOSURE OF THE INVENTION

According to various features, characteristics and embodiments of the present invention which will become apparent as the description thereof proceeds, the present invention provides a melter kettle in combination with a system for feeding materials into the melter kettle which combination includes:

a melter kettle having a top;

a hopper for receiving material to be fed into the melter kettle;

a material transport tube having one end coupled to the hopper and another end coupled to a material feed inlet in the top of the melter kettle;

a rotatable auger in the material transport tube for moving material therethrough; and a flame conductor assembly provided in the top of the melter kettle remote from the hopper for releasing any flames or gasses that build up in the melter kettle.

In a further embodiment the combination also includes an air intake duct provided in the top of the melter kettle through which free air is allowed to enter into the melter kettle so as to equalize pressure with the atmosphere and/or burn off any superheated material The present invention also provides a method of charging material into a melter kettle which involves:

providing a melter kettle having a top;

providing a feed system for the melter kettle which includes:

- a hopper for receiving material to be fed into the melter kettle;
- a material transport tube having one end coupled to the hopper and another end coupled to a material feed inlet in the top of the melter kettle;

a rotatable auger in the material transport tube for moving material therethrough;

a flame conductor assembly provided in the top of the melter kettle remote from the hopper for releasing any flames or gasses that build up in the melter kettle; and an air intake duct provided in the top of the melter kettle through which free air is allowed to enter into the melter kettle so as to equalize pressure with the atmosphere and/or burn off any superheated material;

opening the air intake duct to allow air to enter the melter kettle;

feeling material into the hopper; and activating the auger so as to transport material from the hopper and into the melter kettle.

The present invention also provides a thermoplastic striping vehicle which includes:

at least one melter kettle in combination with a material feed system which includes:

a hopper for receiving material to be fed into the at least one melter kettle;

a material transport tube having one end coupled to the hopper and another end coupled to a material feed inlet in the top of the at least one melter kettle;

a rotatable auger in the material transport tube for moving material therethrough; and a flame conductor assembly provided in the top of the at least one melter kettle remote from the hopper for releasing any flames or gasses that build up in the at least one melter kettle.

In a further embodiment the thermoplastic striping vehicle also includes an air intake duct provided in the top of the melter kettle through which free air is allowed to enter into the melter kettle so as to equalize pressure with the atmosphere and/or burn off any superheated material

BRIEF DESCRIPTION OF DRAWINGS

The present invention will be described with reference to the attached drawings which are given as non-limiting examples only, in which.

BEST MODE FOR CARRYING OUT THE INVENTION

The present invention is directed to melter kettles and more particularly relates to a system for charging or feeding materials into melter kettles. The present invention provides a method to safely add material to thermoplastic melter kettles used for pavement marking. The present invention provides a thermoplastic feeder system that allows feed material to be added to the kettle as a continuous or semi-continuous flow of granular material. The present invention reduces the operator/tender's exposure to splash back and blow back danger. The manner of adding granular material to melter kettles according to the present invention allows for optimum heating rates. In this regard, the addition of granular material to superheated or over heated material using the system of the present invention allows for the most rapid cooling of the material possible. The design of the present invention affects a safer working area for the tenders and other persons or objects in the influence area of the kettles.

Figure 1:
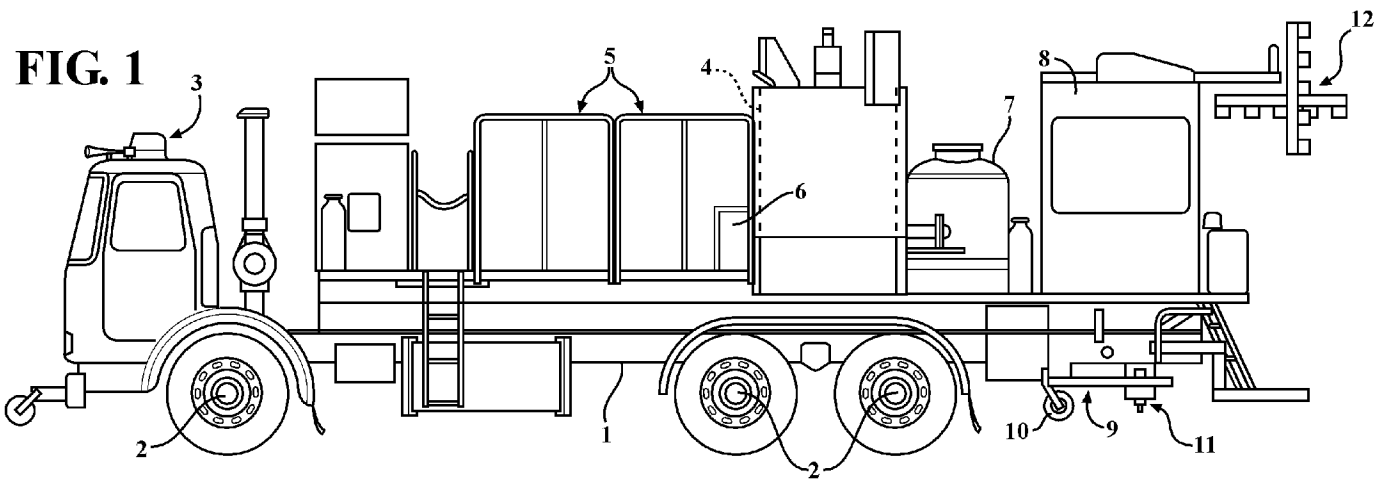
FIG. 1 is a side view of a conventional thermoplastic striping vehicle having kettle melters.
Figure 2:
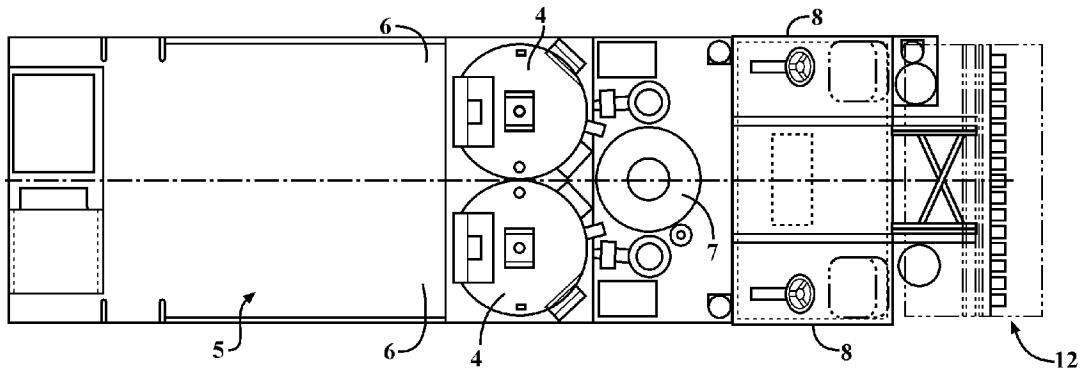
FIG. 2 is a top view of the thermoplastic striping vehicle of FIG. 1.

FIG. 1 is a side view of a conventional thermoplastic striping vehicle having kettle melters according to one embodiment of the present invention. FIG. 2 is a top view of the thermoplastic striping vehicle of FIG. 1. The thermoplastic striping vehicle shown in FIGS. 1 and 2 includes a chassis 1 that is supported by a plurality of axles 2 in a conventional manner. The chassis 1 supports a cab 3 that can house an engine and provides a cabin for a driver. The chassis 1 of the thermoplastic striping vehicle also supports two melter kettles 4 and has a dry material storage area(s) 5 in which feed materials for the melter kettles 4 can be stored. A hinged loading platform 6 is provided for the tender to stand on when loading materials into the top of each melter kettle 4.

The thermoplastic striping vehicle shown in FIGS. 1 and 2 includes a bead tank 7 that holds glass beads which are mixed in the thermoplastic material. At the rear of the thermoplastic striping vehicle are operator stations 8 in which operators who control and operate the striping mechanism 9 can be stationed. The striping mechanism 9 is positioned beneath the operator stations 8 on either side of the thermoplastic striping vehicle as shown and includes a guide wheel 10 and an applicator head 11 for the thermoplastic material. A signboard 12 is shown as being attached to the top portion of the rear of the thermoplastic striping vehicle.

Figure 3:
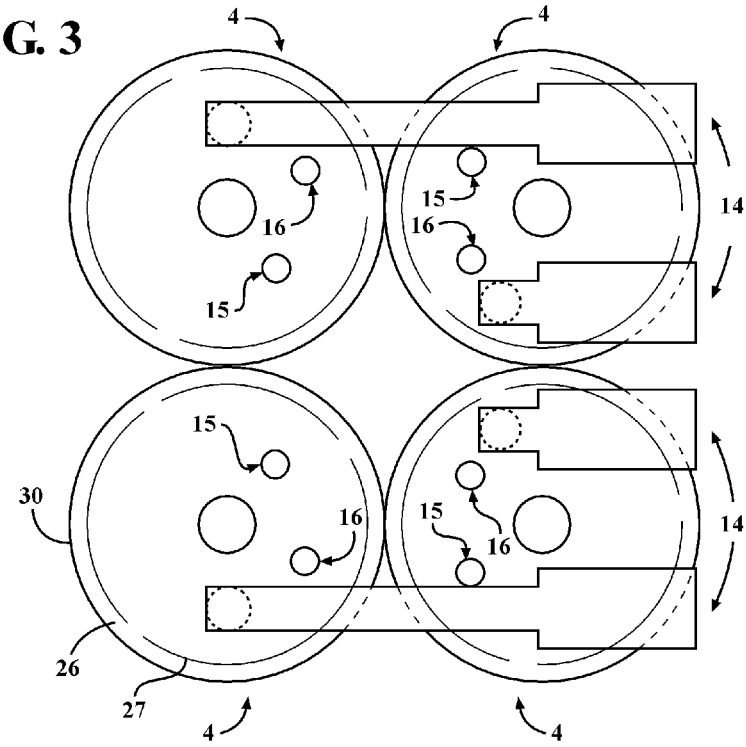
FIG. 3 is a top schematic view of a bank of melter kettles according to one embodiment of the present invention.

FIG. 3 is a top schematic view of a bank of melter kettles according to one embodiment of the present invention. The system shown in FIG. 3 includes four melter kettles 4 whereas the thermoplastic striping vehicle shown in FIGS. 1 and 2 includes two melter kettles 4. As can be understood the present invention can use any number of melter kettles 4. Each of the melter kettles 4 is provided with a vent 13 through which gases used to heat the melter kettles 4 are exhausted, a feed hopper 14, a flameout diverter or flameout conductor assembly 15, and an air intake duct assembly 16.

Figure 4:
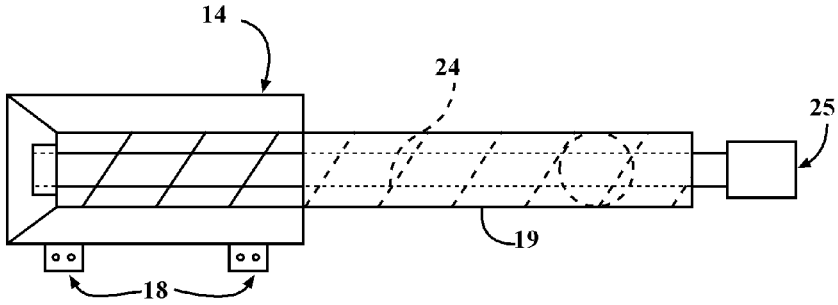
FIG. 4 is a top view of a feed hopper according to one embodiment of the present invention.
Figure 5:
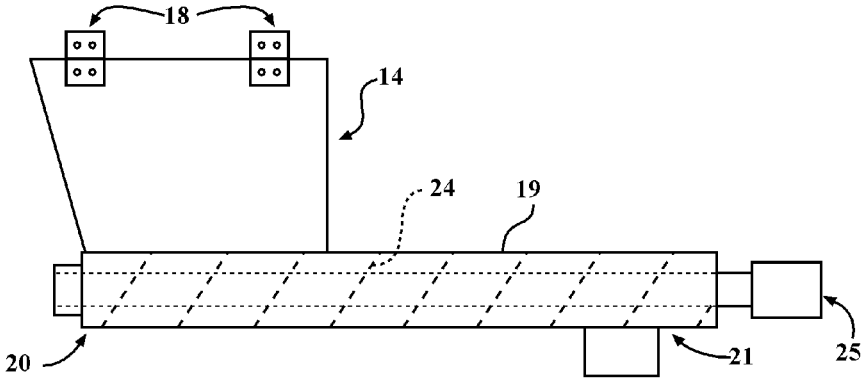
FIG. 5 is a side view of the feed hopper of FIG. 4.
Figure 7A:
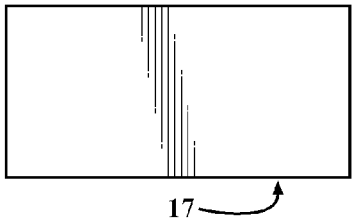
FIGS. 7*a* and 7*b* are top and side views of a lid for a feed hopper according to one embodiment of the present invention.
Figure 7B:
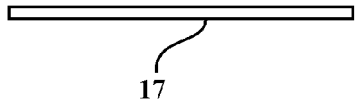

FIG. 4 is a top view of a feed hopper according to one embodiment of the present invention. FIG. 5 is a side view of the feed hopper of FIG. 4. Each feeder hopper 14 has a lid 17 that can be opened. The lids 17 can be hinged for pivotal movement, configured for opening by sliding movement, removable or otherwise configured to be opened in any desired manner. In the embodiment shown, the lid 17 is attached to the feed hopper 14 by hinges 18. The lid 17 prevents rain, snow and debris from entering the melter kettles 4 and prevents flame blow back when closed. The feed hopper 14 is of a dimension adequate to accept the type of thermoplastic feed material that is to be fed into melter kettles 4. FIGS. 7*a* and 7*b* are top and side views of a simple planar lid 17 for a feed hopper 14 according to one embodiment of the present invention that can be attached to the top of a feed hopper 14 by hinges 18. The feed hopper elevation is such that the operator cannot extend any part of the body into the feed hopper 14 while adding material therein.

A material transfer tube 19 has one end 20 that is coupled to the bottom of feed hopper 14 to receive feed materials therein and a second material discharge end 21 that is coupled to a material feed inlet 22 at the top of a melter kettle 4. Material is received from the feed hopper 14 into the material transfer tube 19 and transferred therein to the discharge end 21 at which the materials is discharged or fed into a material feed inlet 22 of a melter kettle 4. The material feed inlet 22 is located such that granular material will drop into the melter kettle 4 at a location that allows for efficient melting and incorporation by the agitator 23.

Figure 6:
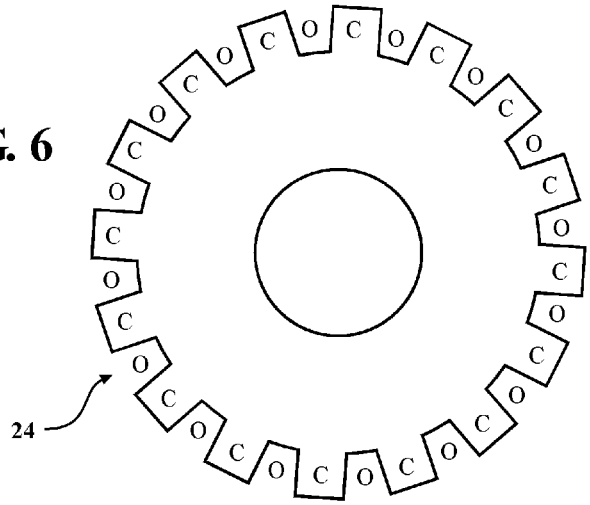
FIG. 6 is a planar view of an auger used in a feed hopper according to one embodiment of the present invention.

A rotating auger 24 extends through the length of the material transfer tube 19 and is driven by a motor 25. The auger 24 can be smooth edged or notched as shown in FIG. 6 over any portion of its length to allow for shredding or de-clumping of material.

Figure 8:
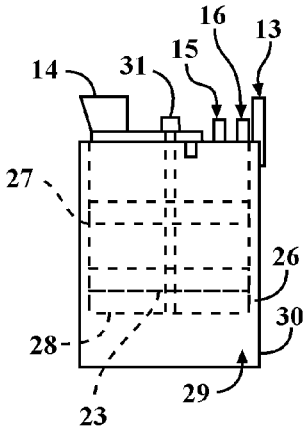
FIG. 8 is a side view of one of the melter kettles of FIG. 3.

FIG. 8 is a side view of one of the melter kettles of FIG. 3. As shown in FIG. 8 and FIG. 3, an air jacket 26 surrounds the sides 27 and bottom 28 of the melter kettle 4. A burner (not shown) heats air in the combustion chamber 29 located at the bottom of the melter kettle 4. The burner can be a conventional gas fired burner or any type of burner/heater. Air that is heated in the combustion chamber 29 travels over the outside bottom 28 and outsides of the sidewalls 27 of the melter kettle 4 and through the air jacket 26. Heat from the heated air is transferred through the melter kettle wall and bottom and into the material in the melter kettle 4. The energy depleted heating air exits through one or more vents 13 at the top of the melter kettle 4. As shown, the melter kettle 4 is wrapped in an insulating skin 30. Also as shown, a rotating agitator 23 is provided inside the melter kettle 4 to mix material therein. A motor 31 provided on the top of the melter kettles 4 drives the agitators 23.

Figure 9:
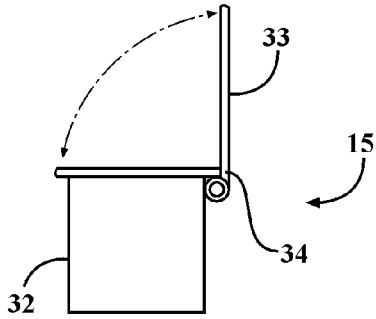
FIG. 9 is a side view of a flameout diverter or flameout conductor duct according to one embodiment of the present invention.

FIG. 9 is a side view of a flameout diverter or flameout conductor assembly according to one embodiment of the present invention. A flame conductor assembly 15 having a flame conductor duct 32 is coupled to an opening in the top of each melter kettle 4. A flapper 33 is connected to the flame conductor duct 32 by a hinge 34. During blow back the flapper 33 is forced open and any flames or gasses that build up in the melter kettle 4 are directed up and out through the flame conductor duct 32 and safely away from any person or source of unintentional combustion. The flapper 33 can be weight-balanced so that it takes less force for gasses to exit the melter kettle 4 through the flame conductor duct 32 than through the material transfer tube 19 with an auger 24 in place. This is an additional safety feature for the operator even if the lid 17 on the feed hopper 14 is open. During normal conditions the flapper 33 rests on the flame conductor duct 32 and prevents rain, snow and debris from entering the melter kettle 4.

Figure 10:
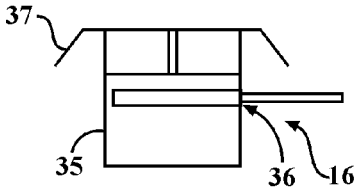
FIG. 10 is a side view of an air intake duct assembly according to one embodiment of the present invention.
Figure 11:
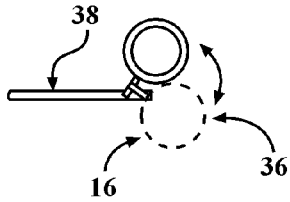
FIG. 11 is a top view of the air intake duct assembly of FIG. 10.

FIG. 10 is a side view of an air intake duct assembly according to one embodiment of the present invention. FIG. 11 is a top view of the air intake duct assembly of FIG. 10. As shown, the air intake duct assembly 16 is coupled to an opening in the top of the melter kettle 4 by an air intake duct 35. The air intake duct 35 is provided with a valve 36, such as a knife valve, that can be controlled remotely, such as by a rod 38, cable or other linkage, at the tender's location. The valve 36 can be controlled by the operator or tender to allow free air into the melter kettle 4 so as to allow for equalization of pressure with the atmosphere and/or burn off caused by superheated material. The air intake duct assembly 16 includes a raised cap 37 which prevents rain, snow and debris from entering the melter kettle 4.

In operation, when it is necessary to add material into one of the melter kettles 4 an operator or tender gains access to the appropriate feed hopper 14 and opens the lid 17 of the feed hopper 14 and charges material into the feed hopper 4 either before or after activating the auger 23 in the material transport tube 19 associated with the feed hopper 14. It is noted that activating the auger 23 after the material is charged into the feed hopper 14 ensures a degree of safety whereby the operator or tender cannot harmed by the auger 23. In this regard, it is within the scope of this invention to equip the feed hopper 14 with a switch that only allows activation of the auger 23 when the lid 17 on the feed hopper 14 is closed. According to the present invention the operator or tender is protected from splash back of molten material and blow back of flames from super heated material due to the fact that the operator or tender is not within proximity to any direct opening of the melter kettle 4. Moreover, the auger 23 within the material transport tube 19 will block splash back of molten material and/or blow back of flames from super heated material, especially when loaded with material. Furthermore, the pressure in the melter kettle 4 is regulated so that any flames or gasses that build up in the melter kettle 4 are directed up and out through the flame conductor assembly 15 which is positioned safely away from the feed hopper 4. Further yet, the air intake duct assembly 16 allows the operator or tender to let free air into the melter kettle 4 (prior to opening the feed hopper 14) so as to allow for equalization of pressure with the atmosphere and/or burn off caused by superheated material.

According to the present invention the augers 23 can be operated in a controlled manner to feed or charge material from the feed hoppers 14 into the melter kettles 4 in a manner that optimizes or reduces the melting time of the added materials.

Although the present invention has been described with reference to particular means, materials and embodiments, from the foregoing description, one skilled in the art can easily ascertain the essential characteristics of the present invention and various changes and modifications can be made to adapt the various uses and characteristics without departing from the spirit and scope of the present invention as described above and as set forth in the attached claims.

What is claimed is:

1. A melter kettle in combination with a system for feeding materials into the melter kettle which combination comprises:

a melter kettle having a top;

a hopper for receiving material to be fed into the melter kettle;

a material transport tube having one end coupled to the hopper and another end coupled to a material feed inlet in the top of the melter kettle;

a rotatable auger in the material transport tube for moving material therethrough;

a flame conductor assembly provided in the top of the melter kettle remote from the hopper for releasing any flames or gasses that build up in the melter kettle; and an air intake duct provided in the top of the melter kettle through which free air is allowed to enter into the melter kettle so as to equalize pressure with the atmosphere and/or burn off any superheated material, wherein the air intake duct can be operated remotely to equalize pressure with the atmosphere and/or burn off any superheated material.

2. The combination of claim 1, wherein the flame conductor assembly has a pressure sensitive opening mechanism.

3. The combination of claim 1, wherein the flame conductor assembly has an un-latched lid that opens due to pressure in the melter kettle.

4. The combination of claim 1, wherein the auger is configured to shred or de-clump material charged into the hopper.

5. The combination of claim 2, wherein the auger is configured to shred or de-clump material charged into the hopper.

6. The combination of claim 1, wherein the hopper is provided with a lid that can be opened to charge material into the hopper.

7. The combination of claim 2, wherein the hopper is provided with a lid that can be opened to charge material into the hopper.

8. The combination of claim 1, wherein the melter kettle is provided on the chassis of a vehicle.

9. The combination of claim 2, wherein the melter kettle is provided on the chassis of a vehicle.

10. The combination of claim 8, wherein the vehicle comprises a thermoplastic striping vehicle.

11. The combination of claim 9, wherein the vehicle comprises a thermoplastic striping vehicle.

12. A method of charging and melting material in a melter kettle which comprises:

providing a melter kettle having a top;

providing a feed system for the melter kettle which includes:

a hopper for receiving material to be fed into the melter kettle;

a material transport tube having one end coupled to the hopper and another end coupled to a material feed inlet in the top of the melter kettle;

a rotatable auger in the material transport tube for moving material therethrough;

a flame conductor assembly provided in the top of the melter kettle remote from the hopper for releasing any flames or gasses that build up in the melter kettle; and an air intake duct provided in the top of the melter kettle through which free air is allowed to enter into the melter kettle so as to equalize pressure with the atmosphere and/or burn off any superheated material;

opening the air intake duct to allow air to enter the melter kettle;

feeding material into the hopper;

activating the auger so as to transport material from the hopper and into the melter kettle;

melting the transported material in the melter; and remotely operating the air intake duct to equalize pressure with the atmosphere and/or burn off any superheated material.

13. A method of charging and melting material in a melter kettle according to claim 12, wherein the rotatable auger is operated to optimize or reduce the melting time of the material entering the melter kettle.

14. A thermoplastic striping vehicle which comprises:

a chassis; and at least one melter kettle in combination with a material feed system mounted on the chassis which includes:

a hopper for receiving material to be fed into the at least one melter kettle;

a material transport tube having one end coupled to the hopper and another end coupled to a material feed inlet in the top of the at least one melter kettle;

a rotatable auger in the material transport tube for moving material therethrough;

a flame conductor assembly provided in the top of the at least one melter kettle remote from the hopper for releasing any flames or gasses that build up in the at least one melter kettle; and an air intake duct provided in the top of the at least one melter kettle through which free air is allowed to enter into the melter kettle so as to equalize pressure with the atmosphere and/or burn off any superheated material, wherein the air intake duct can be operated remotely to equalize pressure with the atmosphere and/or burn off any superheated material.

15. A thermoplastic striping vehicle according to claim 14 further comprising:

an air intake duct provided in the top of the at least one melter kettle through which free air is allowed to enter into the at least one melter kettle so as to equalize pressure with the atmosphere and/or burn off any superheated material.

16. A thermoplastic striping vehicle according to claim 14, wherein the at least one melter kettle comprises a plurality of melter kettles.

17. A thermoplastic striping vehicle according to claim 15, wherein the at least one melter kettle comprises a plurality of melter kettles.

* * * * *